US009121638B2

(12) United States Patent
Black et al.

(10) Patent No.: US 9,121,638 B2
(45) Date of Patent: Sep. 1, 2015

(54) SURFACE DRYERS PRODUCING UNIFORM EXIT VELOCITY PROFILES, AND ASSOCIATED SYSTEMS AND METHODS

(71) Applicant: Dri-Eaz Products, Inc., Burlington, WA (US)

(72) Inventors: Richard A. Black, Bellingham, WA (US); Brett Bartholmey, Bellingham, WA (US); Ryan Kulp, Bellingham, WA (US); Larry White, Mount Vernon, WA (US); William Bruders, Sedro Woolley, WA (US)

(73) Assignee: Dri-Eaz Products, Inc., Burlington, WA (US)

( * ) Notice: Subject to any disclaimer, the term of this patent is extended or adjusted under 35 U.S.C. 154(b) by 217 days.

(21) Appl. No.: 13/843,440

(22) Filed: Mar. 15, 2013

(65) Prior Publication Data

US 2013/0247409 A1 Sep. 26, 2013

Related U.S. Application Data

(60) Provisional application No. 61/615,808, filed on Mar. 26, 2012, provisional application No. 61/703,198, filed on Sep. 19, 2012.

(51) Int. Cl.

| | |
|---|---|
| ***F26B 21/04*** | (2006.01) |
| ***F26B 21/00*** | (2006.01) |
| ***F26B 9/02*** | (2006.01) |

(52) U.S. Cl.

CPC ..... *F26B 21/004* (2013.01); *F26B 9/02* (2013.01)

(58) Field of Classification Search

CPC ..... F26B 19/00; F26B 21/00; F26B 21/004; A47L 9/00; A47L 9/06; F04D 1/00; F04D 29/00; F04D 29/40; F04D 25/00; F04D 25/08

USPC ..... 34/332, 443, 523, 90, 201; 15/320, 322, 15/300.1, 401; 134/21; 239/320, 519; D8/349; 415/1, 211.2, 121.2

See application file for complete search history.

(56) References Cited

U.S. PATENT DOCUMENTS

| | | | |
|---|---|---|---|
| 108,949 | A | 11/1870 | Wheeler |
| D184,468 | S | 2/1959 | Wistrand et al. |

(Continued)

FOREIGN PATENT DOCUMENTS

| | | | |
|---|---|---|---|
| GB | 1558297 | A | 12/1979 |
| GB | 2227943 | A | 8/1990 |

(Continued)

OTHER PUBLICATIONS

Dri-Eaz, Product Catalog, Jan. 1, 2002, pp. 4-7 and 14, Burlington, Washington, U.S.

(Continued)

*Primary Examiner* — Stephen Gravini
(74) *Attorney, Agent, or Firm* — Perkins Coie LLP

(57) ABSTRACT

Surface dryers having uniform exit velocity profiles, and associated systems and methods are disclosed. Surface dryers in accordance with certain embodiments include a housing, a gas driver positioned in the housing, an inlet aperture formed in the housing and positioned upstream of the gas driver, and a nozzle carried by the housing and positioned downstream of the gas driver. The nozzle can have an indentation forming a convergent portion positioned to accelerate the flow of air and a divergent portion positioned to decelerate the flow of air.

20 Claims, 11 Drawing Sheets

(56) References Cited

U.S. PATENT DOCUMENTS

| | | | | |
|---|---|---|---|---|
| 3,319,786 | A | 5/1967 | Rudolf | |
| 3,333,345 | A * | 8/1967 | Miller | 34/528 |
| 3,510,958 | A * | 5/1970 | Van Der Lely | 34/60 |
| D243,243 | S | 2/1977 | Nagao et al. | |
| D254,566 | S | 3/1980 | Cummins | |
| 4,572,188 | A | 2/1986 | Augustine et al. | |
| 5,030,068 | A | 7/1991 | Jacobs et al. | |
| 5,155,924 | A * | 10/1992 | Smith | 34/443 |
| 5,174,048 | A | 12/1992 | Shero | |
| 5,208,940 | A * | 5/1993 | London et al. | 15/345 |
| D340,326 | S | 10/1993 | Genovese | |
| 5,257,467 | A | 11/1993 | White | |
| 5,265,895 | A * | 11/1993 | Barrett | 280/47.24 |
| 5,405,370 | A | 4/1995 | Irani | |
| 5,893,216 | A * | 4/1999 | Smith et al. | 34/103 |
| 5,950,331 | A * | 9/1999 | Coggins et al. | 34/666 |
| 5,954,494 | A | 9/1999 | Goldsmith et al. | |
| 5,991,973 | A | 11/1999 | Simpson | |
| D422,351 | S | 4/2000 | Griffin | |
| 6,195,907 | B1 * | 3/2001 | Bodnar et al. | 34/90 |
| 6,202,322 | B1 | 3/2001 | Turner, IV | |
| D440,298 | S | 4/2001 | Wolfe | |
| D442,740 | S | 5/2001 | Wolfe | |
| 6,367,625 | B1 | 4/2002 | Zobel | |
| 6,401,354 | B1 | 6/2002 | Johnson | |
| D480,467 | S | 10/2003 | White | |
| D484,586 | S * | 12/2003 | Intravatola | D23/370 |
| D488,857 | S | 4/2004 | Wintersteen et al. | |
| 6,739,070 | B1 | 5/2004 | Jacobs et al. | |
| D497,664 | S | 10/2004 | Puri | |
| 6,899,516 | B2 | 5/2005 | Wang | |
| D517,677 | S | 3/2006 | Bartholmey | |
| 7,007,403 | B1 * | 3/2006 | Studebaker | 34/90 |
| D526,751 | S | 8/2006 | Hendy | |
| D533,322 | S | 12/2006 | Blateri | |
| D536,432 | S | 2/2007 | Jackovitch et al. | |
| D537,153 | S | 2/2007 | Hoog et al. | |
| D537,156 | S | 2/2007 | Marengo et al. | |
| D537,517 | S | 2/2007 | Hancock | |
| D565,162 | S | 3/2008 | Carlson | |
| D576,266 | S | 9/2008 | Yamakami | |
| 7,460,370 | B2 | 12/2008 | Cheng et al. | |
| D607,622 | S | 1/2010 | Blateri | |
| D619,698 | S | 7/2010 | Emenheiser et al. | |
| 7,785,064 | B2 * | 8/2010 | Bartholmey et al. | 415/1 |
| D625,799 | S | 10/2010 | Salisbury et al. | |
| 8,296,968 | B2 * | 10/2012 | Hensley | 34/381 |
| D691,336 | S | 10/2013 | Griffin et al. | |
| D698,433 | S | 1/2014 | Tomasiak et al. | |
| D704,908 | S | 5/2014 | Cui | |
| D714,922 | S | 10/2014 | Speh | |
| 2004/0047743 | A1 * | 3/2004 | Dooley et al. | 417/234 |
| 2004/0231181 | A1 | 11/2004 | Coven | |
| 2004/0255484 | A1 | 12/2004 | Storrer et al. | |
| 2005/0084400 | A1 | 4/2005 | Tsai | |
| 2006/0049615 | A1 | 3/2006 | Day | |
| 2006/0056965 | A1 | 3/2006 | Li et al. | |
| 2006/0186225 | A1 * | 8/2006 | Bartholmey et al. | 239/499 |
| 2007/0051007 | A1 | 3/2007 | Reets et al. | |
| 2007/0157485 | A1 | 7/2007 | Andrisin et al. | |
| 2007/0183940 | A1 | 8/2007 | Yamamoto et al. | |
| 2008/0232958 | A1 | 9/2008 | Weyandt | |
| 2009/0304492 | A1 | 12/2009 | Bartholmey et al. | |
| 2010/0040456 | A1 | 2/2010 | Hwang et al. | |
| 2012/0233804 | A1 * | 9/2012 | Studebaker et al. | 15/322 |
| 2013/0247409 | A1 * | 9/2013 | Black et al. | 34/443 |
| 2014/0325865 | A1 * | 11/2014 | Wisherd et al. | 34/255 |

FOREIGN PATENT DOCUMENTS

| | | | |
|---|---|---|---|
| GB | 2397366 | A | 7/2004 |
| GB | 2416676 | A * | 2/2006 |
| GB | 2422192 | A * | 7/2006 |
| GB | 2423810 | A | 9/2006 |
| JP | 02078886 | | 3/1990 |
| JP | 2004261788 | A | 9/2004 |
| SU | 1709951 | A1 | 2/1992 |
| WO | WO-8900622 | A1 | 1/1989 |
| WO | WO-2008137188 | A1 | 11/2008 |

OTHER PUBLICATIONS

Dri-Eaz, Product Catalog, Jan. 1, 2002, pp. 9-12; Burlington, Washington, U.S.

Dri-Eaz, Product Catalog, Jan. 1, 2003, p. 10, Burlington, Washington, U.S.

Jon-Don; Gale Force Air Mover from Dry-Air at Jon-Don; www.jondon.com/galeforce/; Mar. 2003.

International Search Report and Written Opinion for International Patent Application No. PCT/US2013/033740, Applicant: Dri-Eaz Products, mailed Jul. 10, 2013, 12 pages.

Dri-Eaz F504 Velo Low Profile Air Mover-Steambrite Supply, Http://www.steambrite.com/drieaz-velo-f504-profile-mover-free-shipping-p-4917.html, steambrite.co(online), Feb. 2008, 6 pages.

* cited by examiner

SURFACE DRYERS PRODUCING UNIFORM EXIT VELOCITY PROFILES, AND ASSOCIATED SYSTEMS AND METHODS

CROSS-REFERENCE TO RELATED APPLICATION

The present application claims priority to U.S. Provisional Application No. 61/615,808, filed Mar. 26, 2012, and U.S. Provisional Application No. 61/703,198, filed Sep. 19, 2012, which are incorporated herein by reference. To the extent the foregoing application and/or any other materials incorporated herein by reference conflict with the present disclosure, the present disclosure controls.

TECHNICAL FIELD

The presently disclosed technology is directed generally to surface dryers, and in particular embodiments, dryers producing uniform exit velocity profiles, and associated systems and methods.

BACKGROUND

Air dryers or blowers are used to remove moisture from surfaces. A conventional dryer typically directs an air flow across a target surface to remove moisture by evaporation, improved by convection. Dryers are frequently used in commercial or industrial applications, for example to dry the floor surfaces in water damage restoration projects.

DETAILED DESCRIPTION

Aspects of the present disclosure are directed generally to surface dryers. The designs disclosed in the present application represent improvements over existing air movers in the same class that do not produce uniform velocity profiles. Accordingly, aspects of the present disclosure are directed to surface dryers that produce uniform or relatively uniform exit velocity profiles, and associated systems and methods. Although the following description provides many specific details of the following examples in a manner sufficient to enable a person skilled in the relevant art to practice, make and use them, several of the details and advantages described below may not be necessary to practice certain examples and methods of the technology. Additionally, the technology may include other examples and methods that are within the scope of the present technology, but are not described here in detail.

References throughout this specification to "one example," "an example," "one embodiment" or "an embodiment" mean that a particular feature, structure, or characteristic described in connection with the example is included in at least one example of the present technology. Thus, the occurrences of the phrases "in one example," "in an example," "one embodiment" or "an embodiment" in various places throughout this specification are not necessarily all referring to the same example. Furthermore, the particular features, structures, routines, steps or characteristics may be combined in any suitable manner in one or more examples of the technology.

Figure 1:
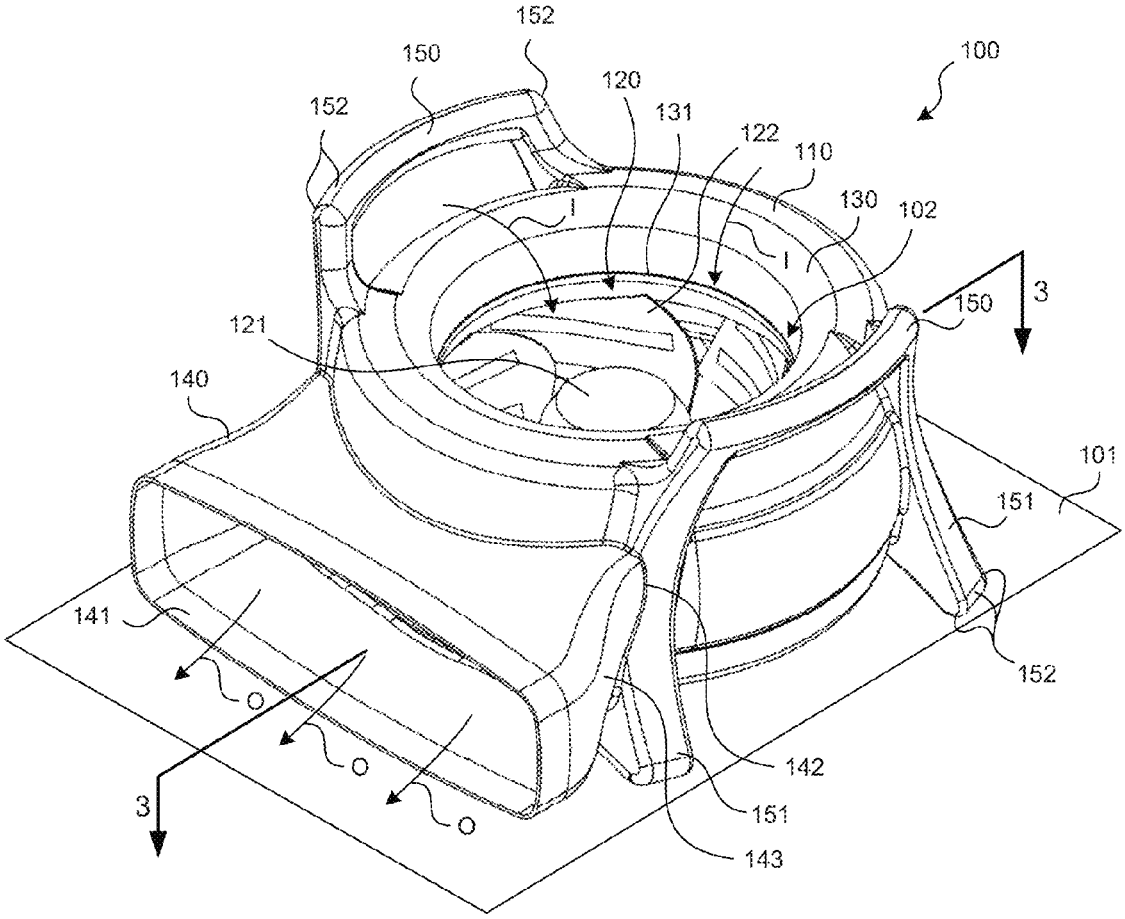
FIG. 1 is a partially schematic, front, top isometric view of a dryer configured in accordance with an embodiment of the presently disclosed technology.

FIG. 1 is a front isometric illustration of an air mover 100 (e.g., a dryer) configured in accordance with an embodiment of the present technology. The air mover 100 is positioned adjacent to a target surface 101. The air mover 100 can include a housing 110 formed from one or more components to enclose or partially enclose a gas driver (e.g., an impeller 120) that accelerates a flow of air and/or another gas to dry the target surface 101. For example, the air mover 100 can include an interior chamber 102 in which the rotating impeller 120 is positioned. The housing 110 can include an inlet 130 having an inlet aperture 131 through which air enters the chamber 102, and a nozzle 140 having an exit aperture (or outlet aperture) 141 through which the accelerated air exits. For purposes of illustration, a grille, screen or other device typically positioned across the inlet aperture 131 is not shown in the Figures.

The impeller 120 spins within the chamber 102 so as to draw air inwardly through the inlet aperture 131 as indicated by arrows I and direct the air outwardly through the exit aperture 141, as indicated by arrows O. In the illustrated embodiment, the impeller 120 can be "backward inclined," for example, so as to rotate in a clockwise direction with radially-inwardly positioned edges of the blades forming leading edges. The air mover 100 can further include one or more handles 150 that allow the air mover 100 to be readily carried and positioned. The air mover 100 can include additional supports 151 (e.g., standoffs, projections, and/or other elements) that allow the air mover 100 to be positioned in any of a multiplicity of orientations, so as to dry surfaces having any of a corresponding multiplicity of orientations. Accordingly, the handles 150 and the supports 151 can each include multiple engaging surfaces 152.

One feature of an embodiment of the dryer shown in FIG. 1 is that the nozzle 140 can have a converging-diverging configuration. For example, the nozzle 140 can include a first or convergent portion 142 through which air is constricted and accelerated and a second or divergent portion 143 through which the constricted air is expanded and decelerated. Accordingly, the nozzle 140 can operate generally in the manner of a venturi device to first accelerate and then decelerate the air flow. In some embodiments, the nozzle 140 and the housing 110 can be integrally formed. In other embodiments, the nozzle 140 can be formed independently and coupled to the housing 110.

Figure 2:
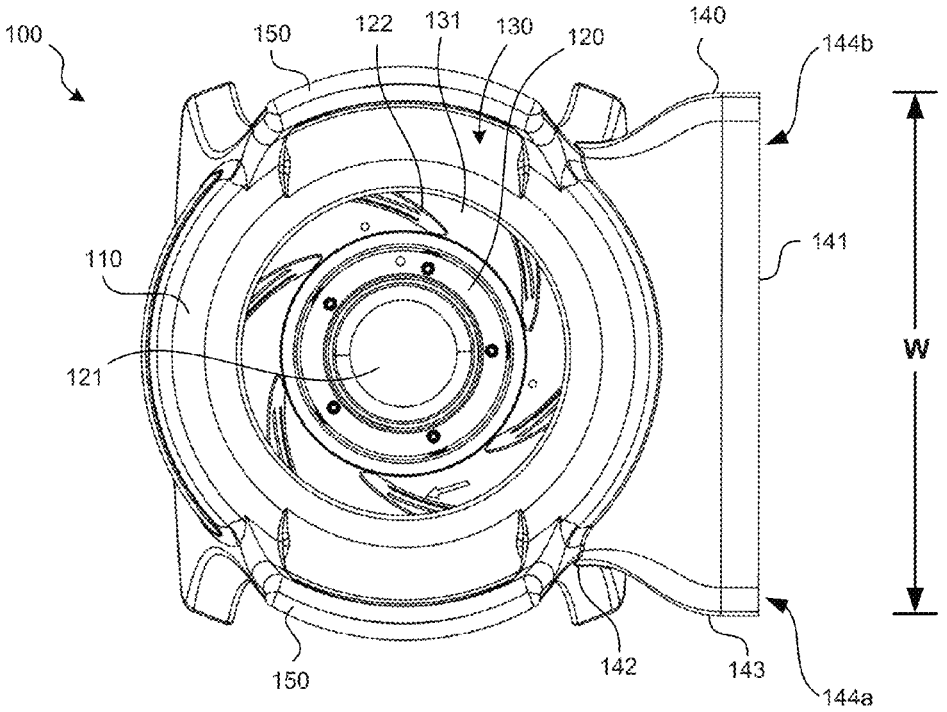
FIG. 2 is a partially schematic top view of an embodiment of the dryer shown in FIG. 1.
Figure 3:
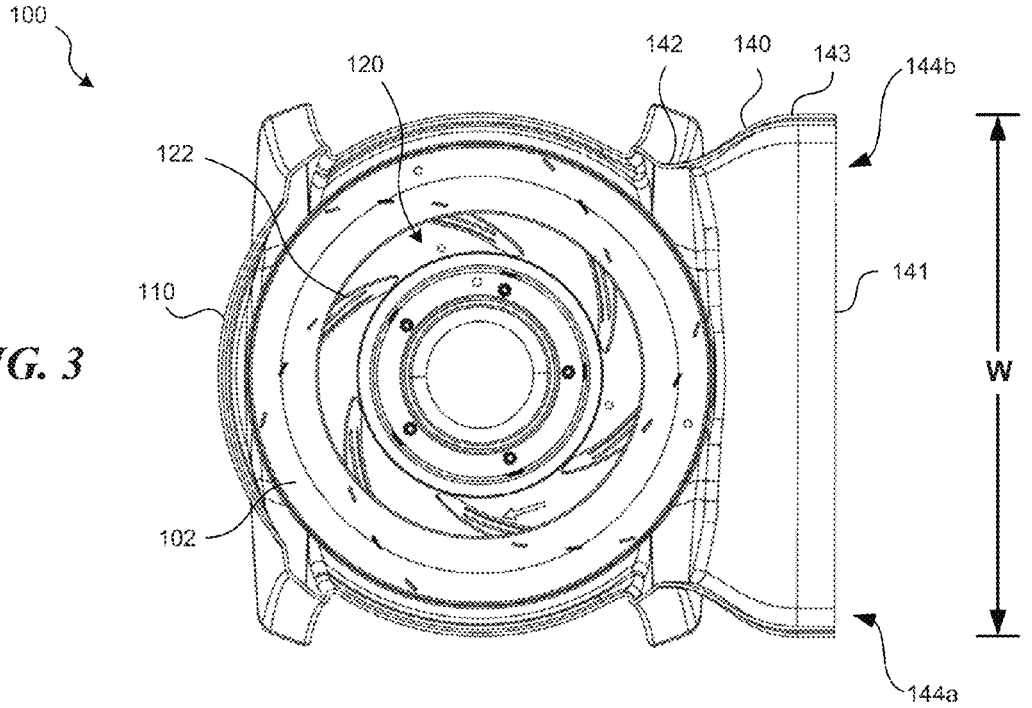
FIG. 3 is a partially schematic top, cross-sectional view of an embodiment of the dryer taken substantially along line 3-3 of FIG. 1.

FIG. 2 is a top view of an embodiment of the air mover 100 shown in FIG. 1, and FIG. 3 is a cross-sectional view of the air mover 100 taken substantially along line 3-3 of FIG. 1. FIGS. 2 and 3 further illustrate the impeller and the converging-diverging shape of the nozzle 140. As shown in FIG. 2, the nozzle 140 can have a symmetric shape. The impeller 120 can include radially extending vanes or blades 121. As the impeller 120 rotates (e.g., in a clockwise direction) it directs air into the nozzle 140 and drives a flow of air along an airflow path passing through the air mover 100. The airflow path can include a plurality segments corresponding to the components of the air mover 100. For example, the airflow path can include a first segment located at the inlet aperture 131, a second segment located at the convergent portion 142, a third segment located at the divergent portion 143, and a fourth segment located at the exit aperture (or outlet aperture) 141. Due to the rotation direction of the impeller 120, air in one portion 144*a* of the exit aperture 141 (e.g., toward the bottom of FIG. 1) may tend to have a higher velocity than the air in another portion 144*b* of the exit aperture 141 (e.g., toward the top of FIG. 1). In some embodiments, the first segment of the airflow path located at the inlet aperture 131 can be substantially parallel to the fourth segment of the airflow path located at the exit aperture 141. In some embodiments, the second segment of the airflow path located at the convergent portion 142 can be substantially parallel to the third segment of the airflow path located at the divergent portion 143. The nozzle 140 can include a smoothly contoured convergent portion 142 and divergent portion 143. Accordingly, the nozzle 140 can accelerate and decelerate the flow of air through it, in a manner that redistributes the air flow velocity gradient or otherwise reduces variations and/or distortions in the velocity profile of the flow exiting the nozzle 140. Accordingly, it is expected that this arrangement can more efficiently dry surfaces than arrangements that lack such a feature. In particular, it is expected that the convergent and divergent portions will smooth out or at least partially smooth out the velocity distribution across the width W of the nozzle exit in a manner measurably better than nozzles without these features.

Figure 4:
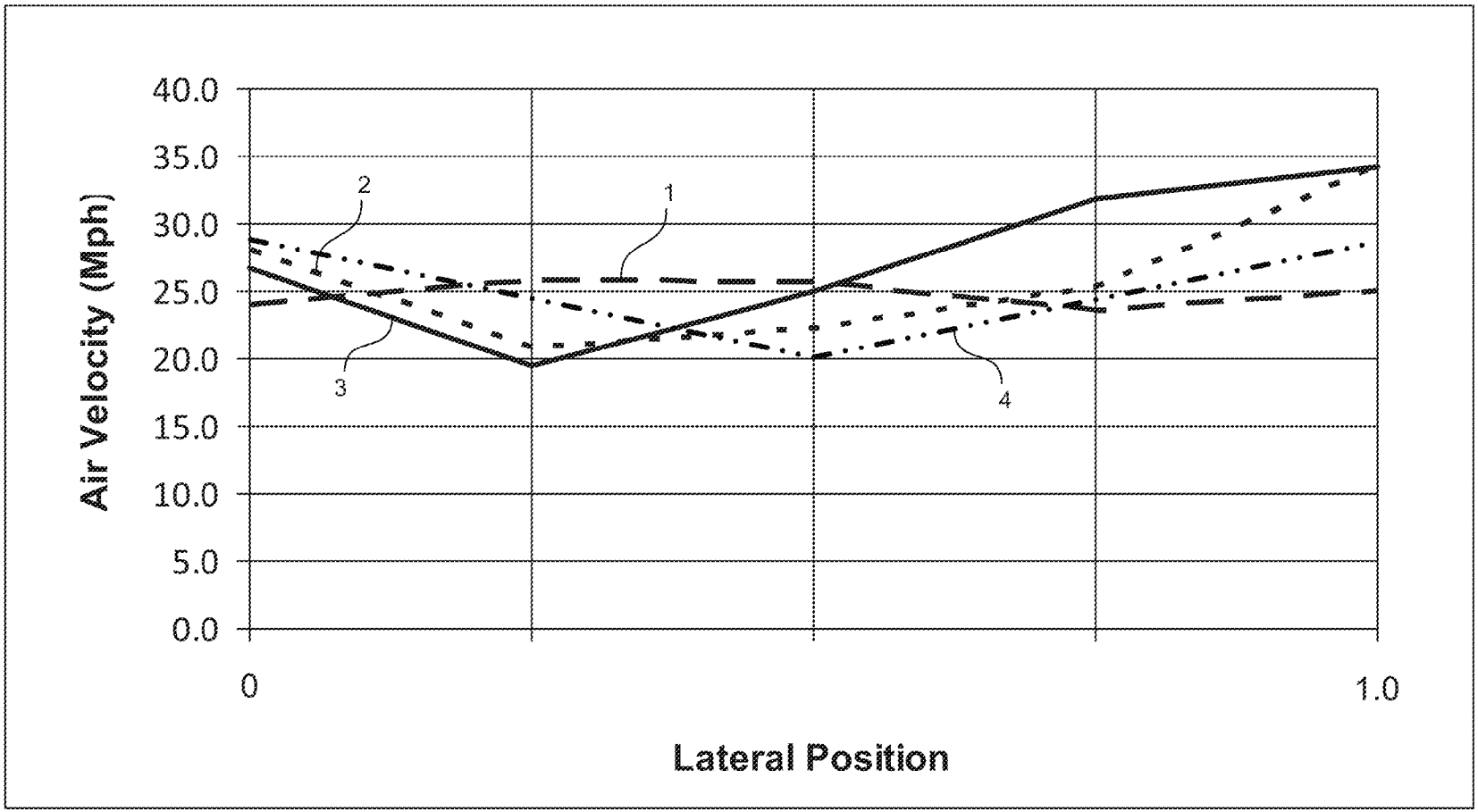
FIG. 4 is a graph illustrating air velocity as a function of lateral position across the widths of representative nozzle exits, with and without features in accordance with embodiments of the present technology.

The foregoing expectation has been borne out by experimental data, as shown in FIG. 4. FIG. 4 illustrates air velocity as a function of non-dimensionalized lateral position across the width of a representative nozzle in accordance with an embodiment of the present disclosure, as compared with nozzles, lacking a convergent-divergent shape. Curve 1 illustrates the velocity distribution for a nozzle having a convergent-divergent shape, and curves 2 and 3 illustrate velocity distributions for two different nozzles that lack the convergent-divergent shape. As is clearly shown in FIG. 4, the convergent-divergent shape produces a more uniform exit velocity across the width of the nozzle. This in turn is expected to produce more uniform drying results during normal use.

As shown in FIG. 4, the highest exit velocity of Curve 1 is about 26 mph, the lowest exit velocity of Curve 1 is about 23.5 mph, and the average exit velocity of Curve 1 is about 25 mph. Accordingly, the exit velocity variance indicated by Curve 1 is about 10% (i.e., 2.5/25). In contrast, the highest exit velocity of Curve 2 is about 34 mph, the lowest exit velocity of Curve 2 is about 21 mph, and the average exit velocity of Curve 2 is again about 25 mph. Accordingly, the exit velocity variance of Curve 2 is about 52% (i.e., 13/25). The highest exit velocity of Curve 3 is about 34 mph, the lowest exit velocity of Curve 3 is about 19.5 mph, and the average exit velocity of Curve 3 is again about 25 mph. Accordingly, the exit velocity variance of Curve 3 is about 58% (i.e., 14.5/25). Therefore, the present technology provides significantly more uniform exit velocity profiles (by substantially reducing the variance of the exit velocity) than do conventional arrangements. In other embodiments, the exit velocity can range from 10% to 45% (e.g., about 15%, 20%, 25%, 30%, 35%, or 40%).

In addition to providing exit velocity profiles with less variance (e.g., Curve 1 in FIG. 4), the present technology can provide other types of controlled exit velocity profiles depending on users' needs. For example, a particular embodiment of the present technology can provide a "V-shaped" exit velocity profile (e.g., Curve 4 in FIG. 4) by adjusting the convergent portion 142 and the divergent portion 143, and by "pinching" the outer extremities of the outlet aperture 141. More specifically, the "V-shaped" exit velocity profile represents a lower exit velocity (e.g., 20 mph as shown in FIG. 4) at the center of the outlet aperture 141, and higher exit velocities at two ends (or edges) of the outlet aperture 141. The present technology can generate other suitable types of uniform exit velocity profiles to meet different user needs. For example, FIG. 14A, discussed later, illustrates an embodiment that produces a uniform exit velocity with a deliberately asymmetric exit shape.

Figure 5:
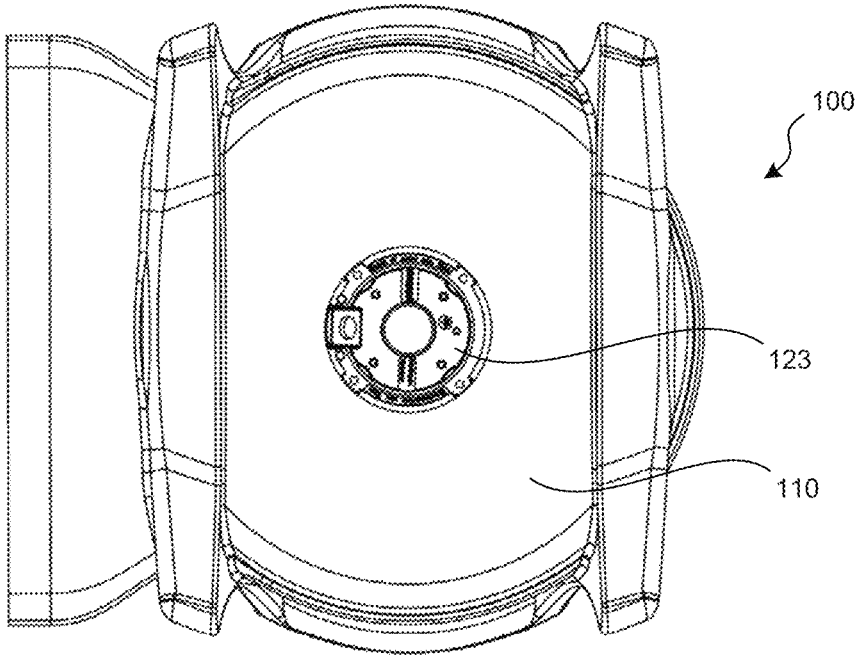
FIG. 5 is a partially schematic bottom view of an embodiment of the dryer shown in FIG. 1.

FIG. 5 is a bottom view of an embodiment of the air mover 100 shown in FIG. 1 and illustrates an impeller support 123 that rotatably supports the impeller 120 shown in FIG. 1. Accordingly, the impeller support 123 can carry a motor, bearing, electrical attachments and controls, and/or other features suitable for driving the impeller 120.

Figure 6:
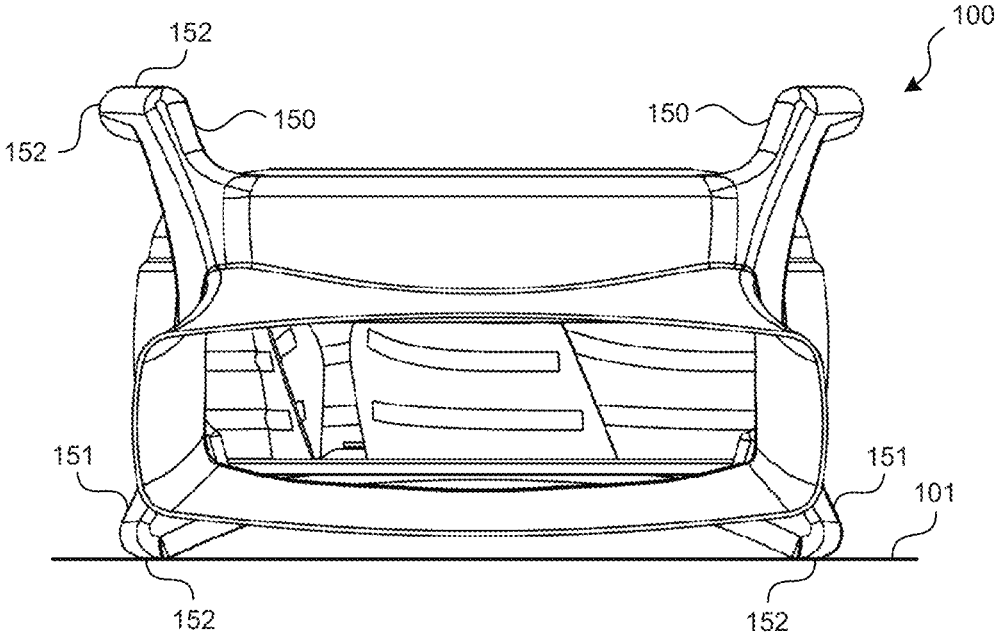
FIG. 6 is a partially schematic front view of an embodiment of the dryer shown in FIG. 1.
Figure 7:
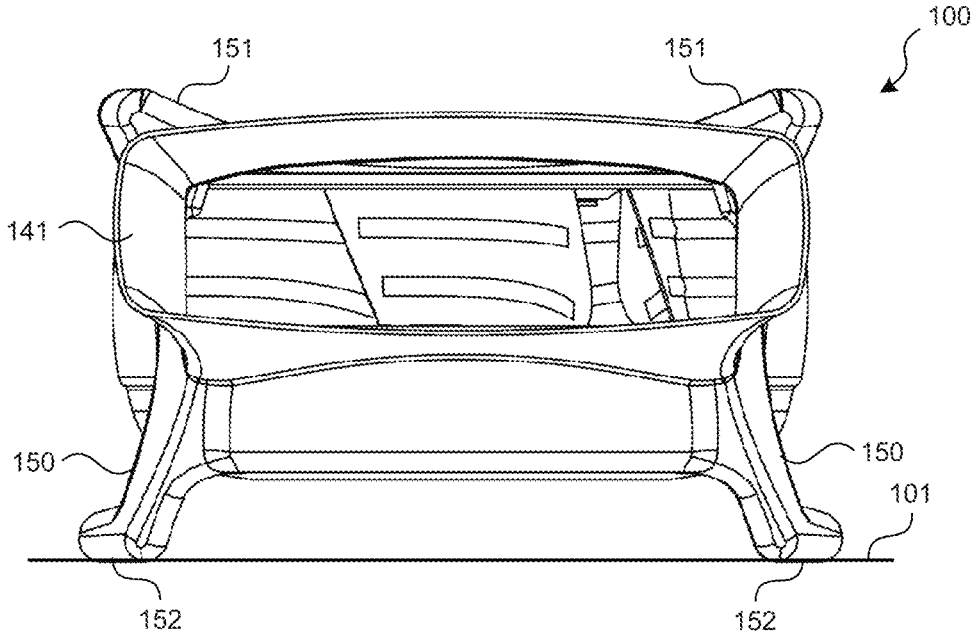
FIG. 7 is a partially schematic front view of an embodiment of the dryer shown in FIG. 1, inverted relative to the position shown in FIG. 6.

FIG. 6 is a front view of an embodiment of the air mover 100 shown in FIG. 1. As shown in FIG. 6, the handle 150 and supports 151 each have engaging surfaces 152 that allow the air mover 100 to be placed in the orientation shown in FIG. 6, or in an inverted orientation as shown in FIG. 7. In the orientation shown in FIG. 6, the air mover 100 can direct air primarily along the surface 101 below it. In the inverted position shown in FIG. 7, the exit aperture 141 of the air mover is elevated above the surface 101, and can direct air over greater distances, into elevated openings, and/or in other fashions.

Figure 8:
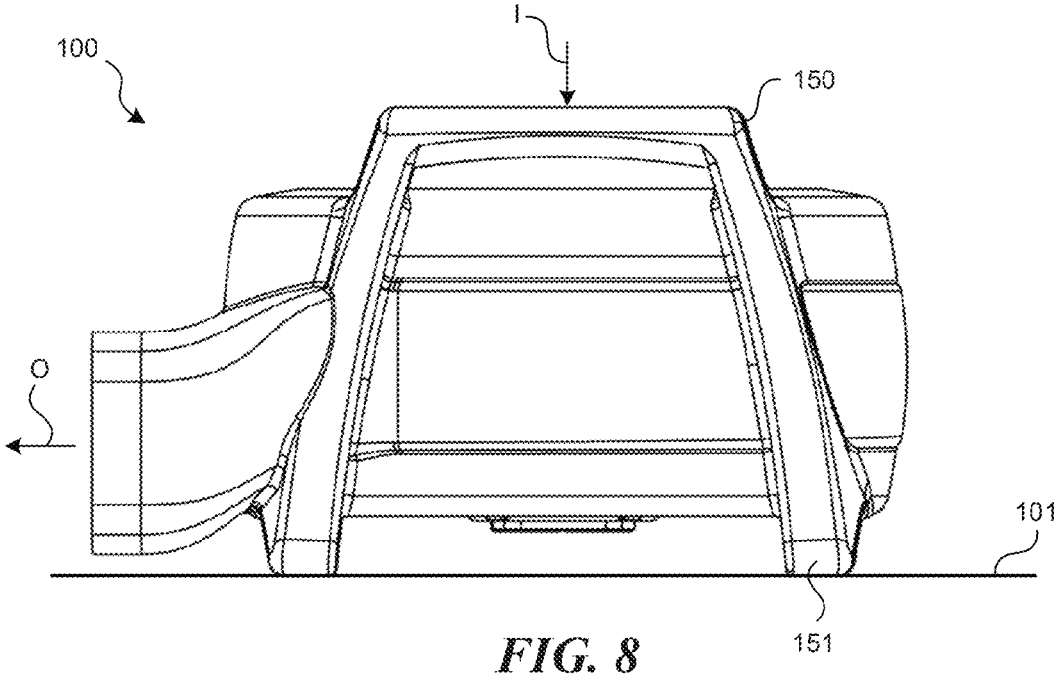
FIG. 8 is a partially schematic, right side elevation view of an embodiment of the dryer shown in FIG. 1.
Figure 9:
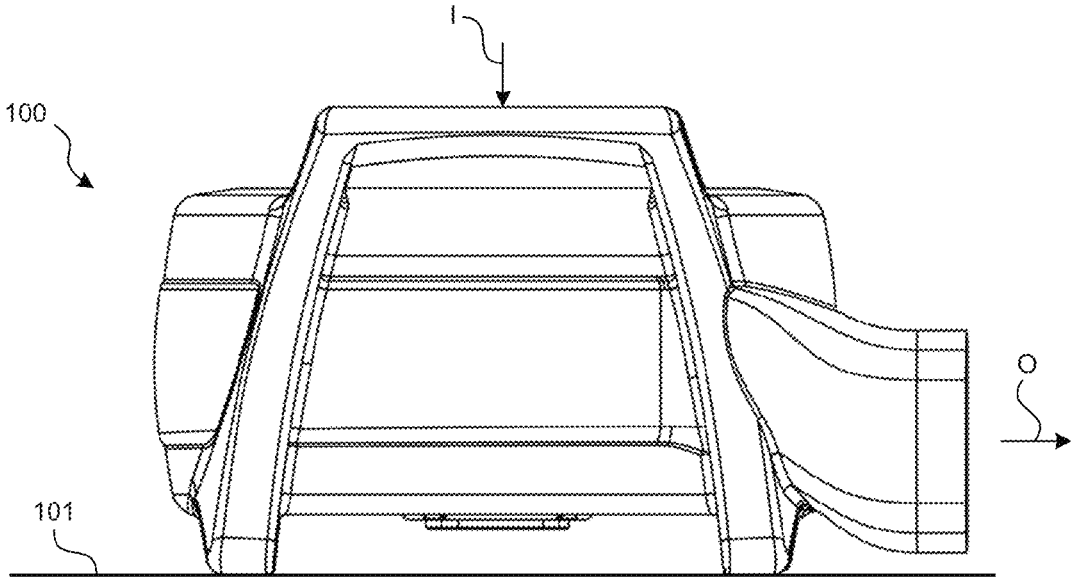
FIG. 9 is a partially schematic, left side elevation view of an embodiment of the dryer shown in FIG. 1.

FIGS. 8 and 9 are right side and left side views, respectively, of an embodiment of the air mover 100 shown in FIG. 1. In the orientation shown in FIGS. 8 and 9, the air mover 100 is positioned to direct air along the surface 101 as shown by arrows O, e.g., to dry the surface.

Figure 10:
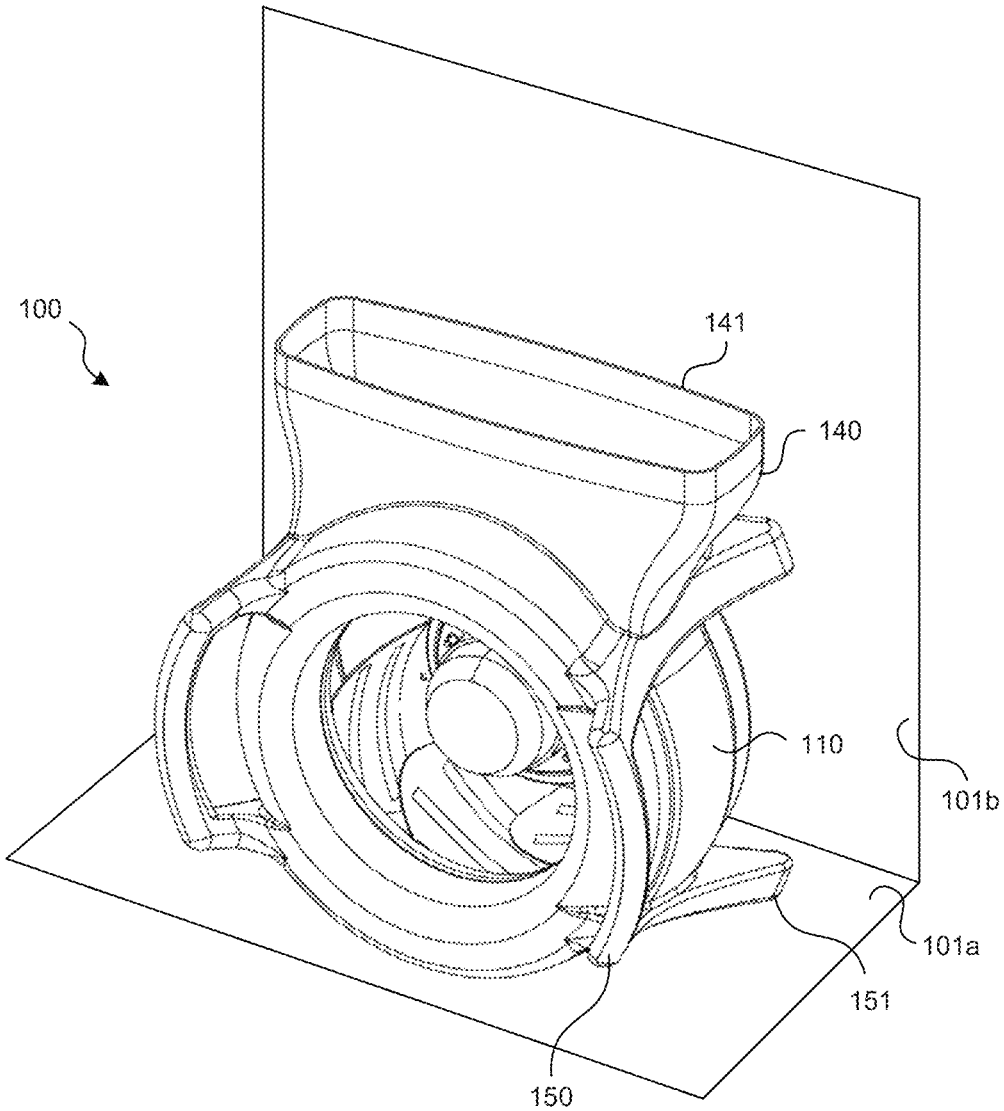
FIG. 10 is an illustration of a dryer positioned to dry a generally vertical surface in accordance with an embodiment of the present disclosure.

FIG. 10 is an isometric illustration of an embodiment of the air mover 100 positioned to direct air in a generally vertical direction. Accordingly, the air mover 100 can be positioned so as to rest on a first surface 101*a* via both the handles 150 and the supports 151, with the nozzle exit aperture 141 facing generally upwardly. This orientation can be used to dry a vertical second surface 101*b*, or other surfaces (e.g., a horizontal surface, not shown) positioned above the first surface 101*a* on which the air mover 100 rests.

Figure 11:
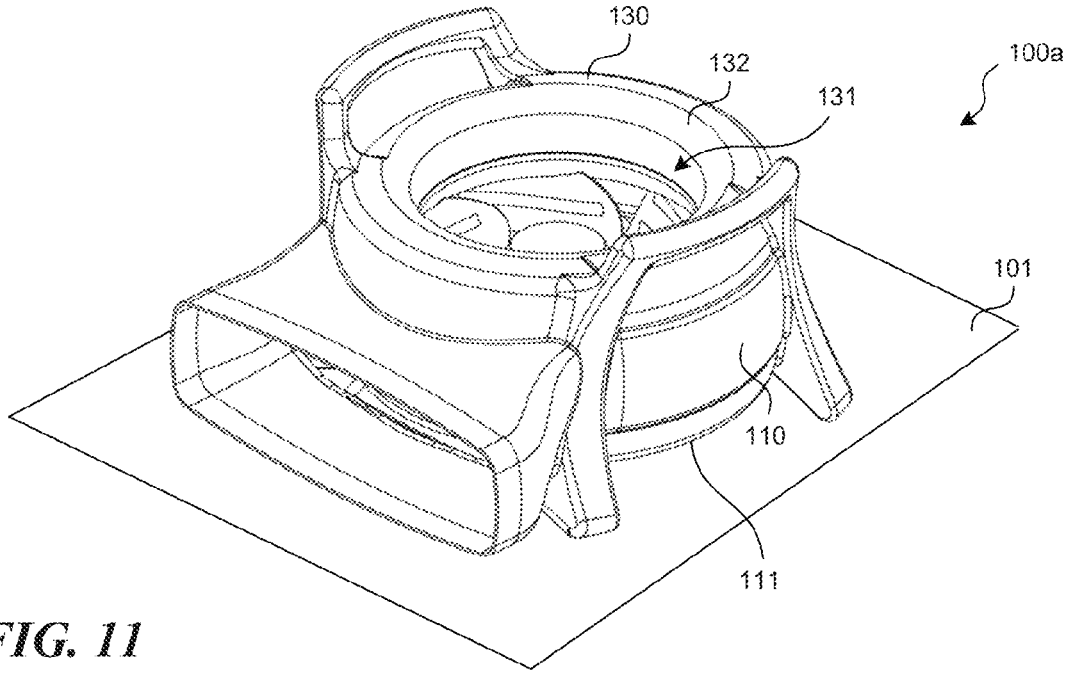
FIG. 11 is a partially schematic, isometric illustration of an embodiment of the dryer positioned to dry a generally horizontal surface in accordance with an embodiment of the present technology.
Figure 12:
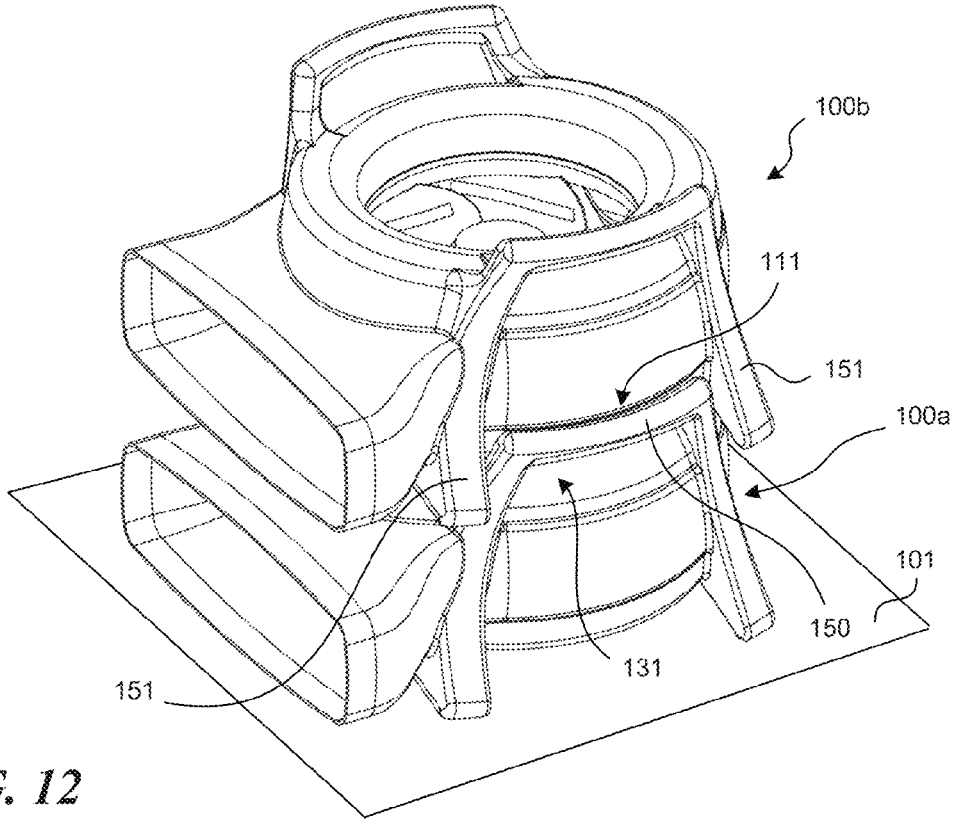
FIG. 12 is a partially schematic, isometric illustration of two dryers stacked one above the other in accordance with another embodiment of the present disclosure.

FIG. 11 illustrates a first air mover 100*a* positioned in an orientation generally similar to that described above with reference to FIG. 1 to dry a floor surface 101. The air mover 100*a* includes an inlet contour 132 at the inlet 130, and a contoured lower surface 111 opposite the inlet 130. In FIG. 12, a second air mover 100*b* has been stacked upon the first air mover 100*a*, shown in FIG. 11, with the contoured lower surface 111 of the second air mover 100*b* nested with and/or at least partially received by the inlet contour 132 of the first air mover 100*b*. The supports 151 of the second air mover 100*b* can be splayed around the handles 150 of the first air mover 100*a* to avoid interference between these elements. In this orientation, the two air movers 100*a*, 100*b* can be easily stored or moved together from one location to another.

Figure 13:
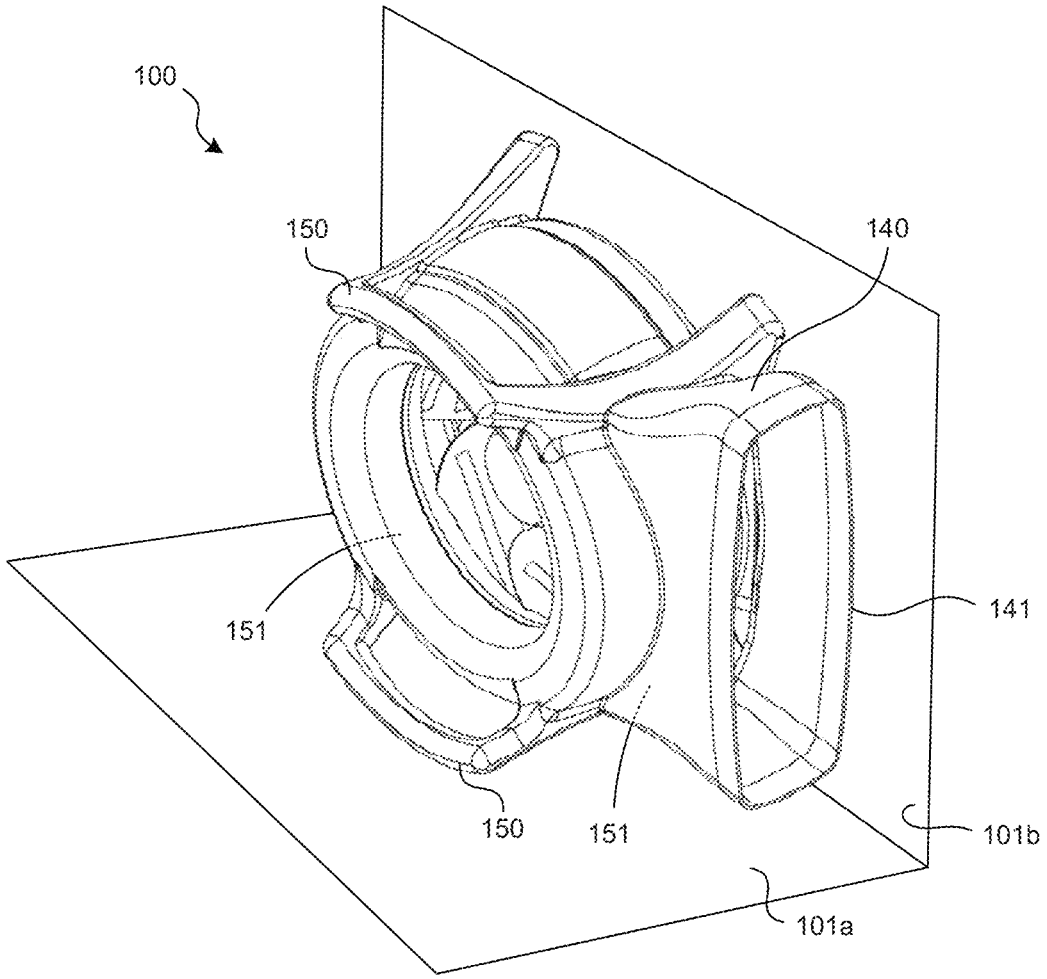
FIG. 13 is a partially schematic, isometric illustration of a dryer positioned to dry a generally vertical surface in accordance with another embodiment of the present disclosure.

FIG. 13 is an isometric illustration of an embodiment of the air mover 100 positioned to direct air in a generally horizontal direction along a generally vertical surface. Accordingly, the air mover 100 can be positioned so as to rest on a first (e.g., horizontal) surface 101*a* via one handle 150 (e.g, the lower handle 150) and two supports 151 (e.g., the two lower supports 151, not visible in FIG. 13), with the nozzle exit aperture 141 facing generally horizontally. This orientation can be used to a dry second (e.g., vertical) surface 101*b*. The ability of the nozzle 140 to produce a generally uniform exit velocity profile at the exit 141 can be particularly beneficial with the air mover 100 in this orientation because without this feature, the nozzle 140 might direct air downwardly to the first surface 101*a*, or upwardly rather than along the second surface 101*b*.

Figure 14A:
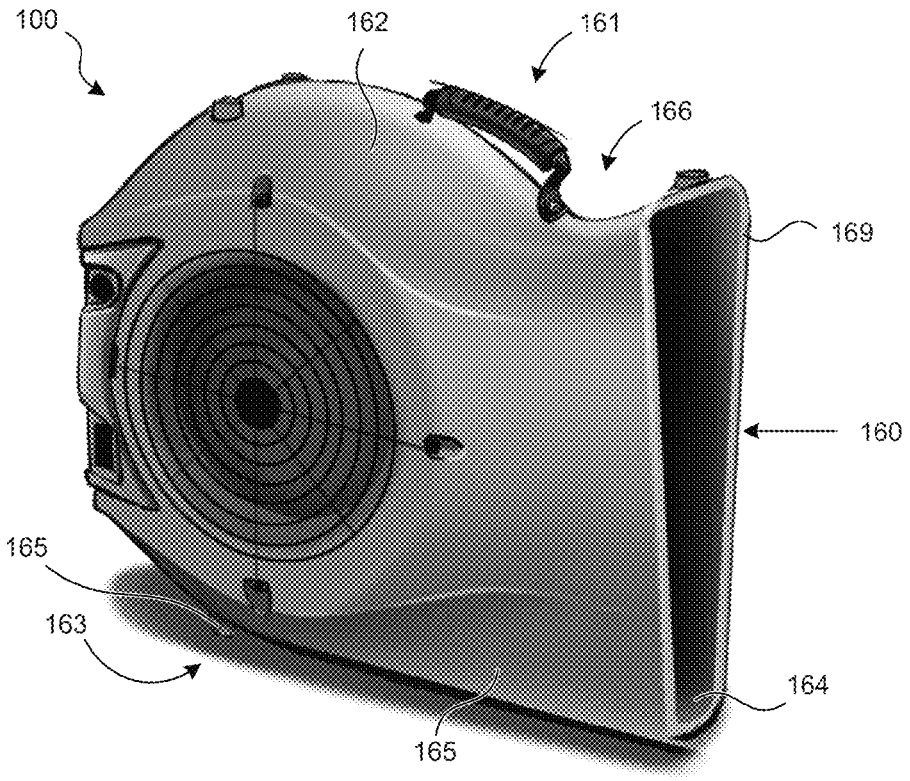
FIGS. 14A and 14B are partially schematic, isometric illustrations of a dryer in accordance with another embodiment of the present disclosure.

FIG. 14A is an isometric illustration of an embodiment of the air mover 100 having an asymmetric air outlet 160. The air mover 100 can have a first side 161 and a second side 163 opposite the first side 161. There are at least two characteristics of the air outlet 160 that can produce the asymmetry, including (1) an indent or indentation 166 (e.g., can function similarly to the converging/diverging portions discussed above) formed in only one side of a housing 162 of the air outlet 160, and (2) a pinched region 164 formed at an exit region 169 of the air outlet 160. The asymmetric air outlet 160 can still generate a uniform exit velocity profile (e.g., after the combined effect of the characteristics discussed above). As shown in FIG. 14A, the asymmetric air outlet 160 can have an asymmetric shape that includes the indentation 166 on only one side of the air outlet 160, and the pinched region 164, also on only one side of the air outlet 160. In other embodiments, the air outlet 160 can have only the indentation 166 without the pinched region 164, or vice versa. The indentation 166 with the converging/diverging shape can even out the velocity profile. For example, the indentation 166 can control mass flow rate for a select velocity profile across the air outlet 160. In another embodiment, an additional or alternate indentation 168 can be employed (e.g., on the second side 163). As shown in FIG. 14A, the indentation 166 is on the first side 161, and a support device 165 is positioned at the second side 163 to support the air mover 100. The support device 165 can have an engaging surface to contact a surface where the air mover 100 is positioned. As shown in FIG. 14A, the pinched region 164 can be formed by "pinching" the outer extremities of the air outlet 160. The pinched region 164 can locally increase the air velocity at the pinched region 164 relative to other regions at the air outlet 160.

Figure 14B:
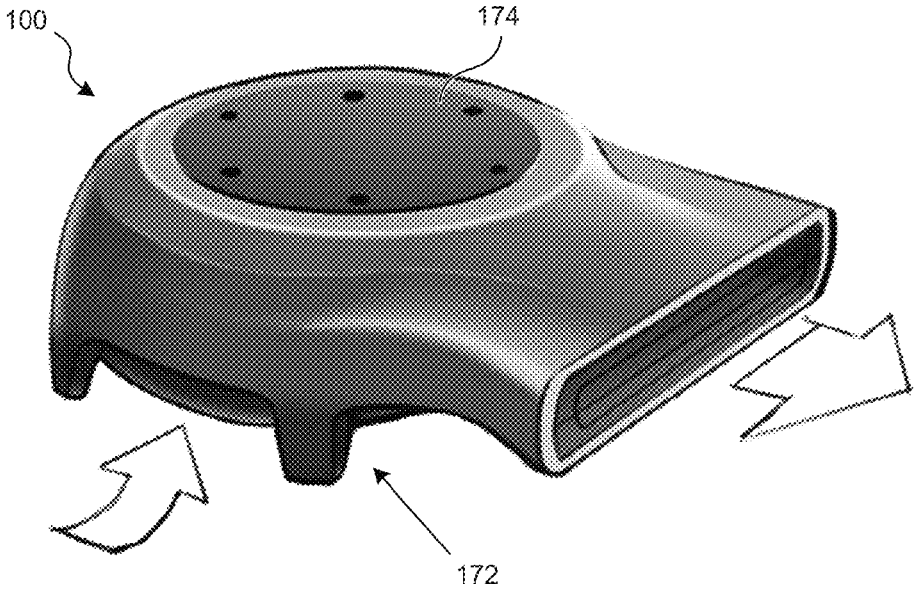

FIG. 14B is an isometric illustration of an embodiment of the air mover 100 having an air inlet 170 positioned at the bottom of the air mover. The air inlet 170 can be located at a selected height from a floor surface. For example, stand-offs 172 can hold the air inlet 170 at the selected height. The air inlet 170, by being proximate to the flooring surface, draws air over the flooring surface to dry the flooring surface proximate to the air inlet 170 and the housing body of the air mover 100. Conventional air movers, by contrast, are prone to create localized wet spots underneath and near the unit because of stagnant air flow near the unit. As shown in FIG. 14B, the upper surface of the air mover 100 can have a cover 174 to prevent outside objects from accidentally engaging the gas driver (e.g., the impeller 120) positioned therein (i.e. there is no aperture on the top surface of the air mover 100). In some embodiments, the cover can be integrally formed with the housing 110 of the air mover 100.

Figure 14C:
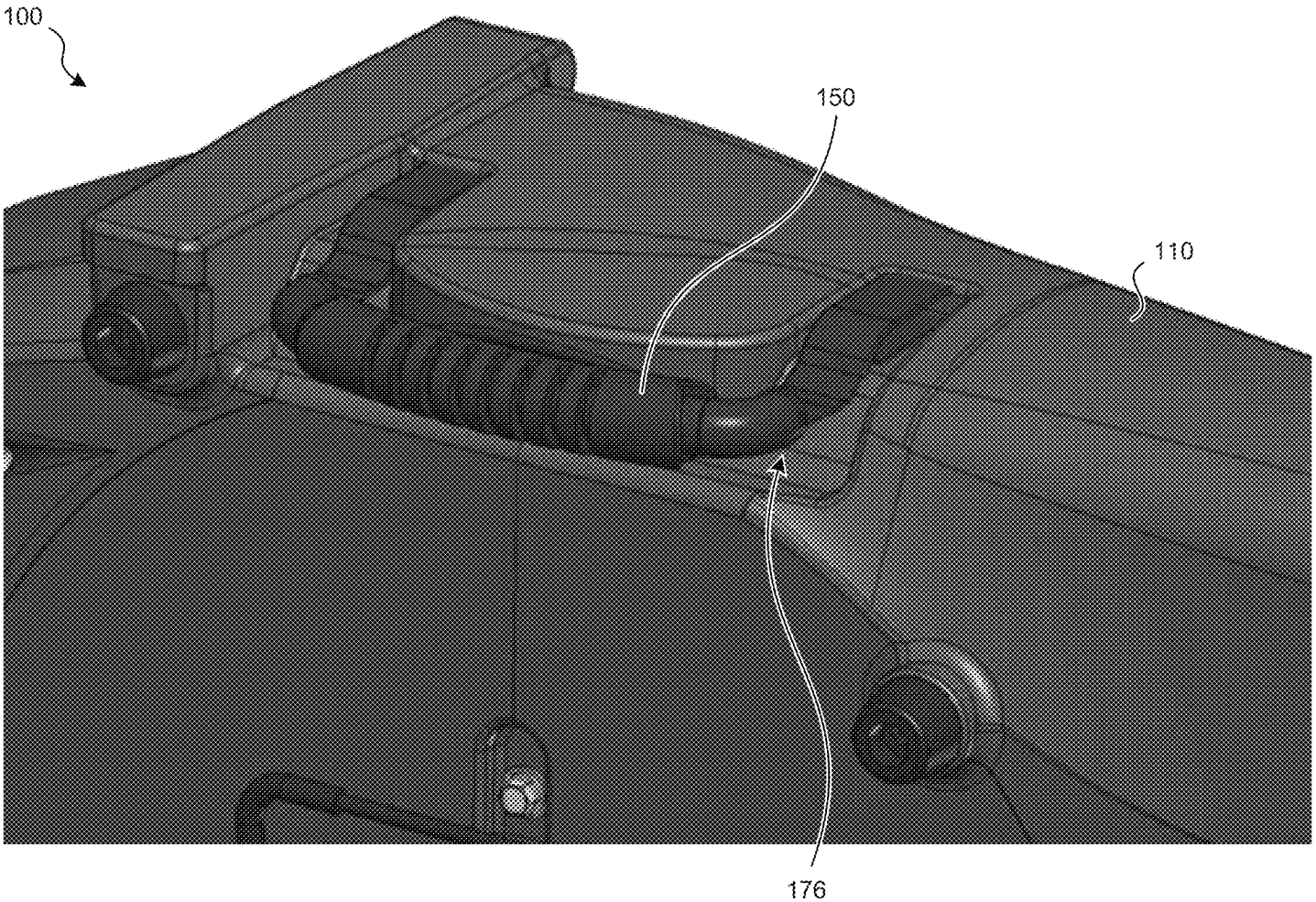
FIG. 14C is a partially schematic, isometric illustration of a handle in accordance with an embodiment of the present disclosure.

FIG. 14C is a partially schematic, isometric illustration of a handle in accordance with an embodiment of the present disclosure. As shown in FIG. 14C, the handle 150 of the air mover 100 can be "tucked" or "locked" into a recess 176 formed with the housing 110 such that the housing 110 can have a substantially planar surface on the handle side. The substantially planar surface on the handle side of the housing 110 allows the air mover 100 to be positioned on a floor surface stably (e.g., so that the handle 150 does not disturb or interfere with the positioning of the air mover 100).

The present technology also includes methods for drying surfaces. Methods in accordance with embodiments of the present technology can include positioning a surface dryer (e.g., the air mover 100) proximate to a surface to be dried. The surface dryer can have a housing (e.g., the housing 110) and a support device (e.g., the supports 151) coupled to the housing. In some embodiments, the support device can contact the surface via an engaging surface. The method can further include introducing a flow of air through an inlet aperture (e.g. the inlet aperture 131) and into the housing via an impeller (e.g., the impeller 120). The impeller can be carried by or positioned in the housing. The method can further include accelerating the flow of air via a convergent portion (e.g., the convergent portion 142) of the housing, and decelerating the flow of air via a divergent portion (e.g., the divergent portion 143). In some embodiments, the convergent portion and the divergent portion can be integrally formed with the housing. In other embodiments, the surface dryer can further include a nozzle (e.g. the nozzle 140) coupled to the housing, and the convergent portion and the divergent portion can be parts of the nozzle. The method can further include discharging the flow of air to the surface to be dried via an outlet aperture (e.g., the exit aperture 141) of the housing.

In some embodiments, the surface dryer can be positioned on a surface different from the surface to be dried. For example, the surface dryer can be positioned on a first surface and can discharge the flow of air to a second surface that is generally perpendicular to the first surface. In some embodiments, the method can further include stacking another (or a second) surface dryer on the (first) surface dryer. For example, the inlet aperture of the (first) surface dryer can have a concave contoured shape (e.g., on the top side of the first surface dryer) that at least partially matches a corresponding convex contoured surface on the bottom side of the other (or the second) surface dryer.

In various embodiments, methods in accordance with the present technology can include locally adjusting (e.g., increasing) the air velocity of a portion of the flow of air by a pinched region (e.g, the pinched region 164 in FIG. 14A) formed at the housing. As discussed above, the pinched region can locally increase the air velocity, the convergent portion can increase the overall air velocity, and the divergent portion can reduce the overall air velocity. The foregoing effects together form a uniform exit velocity profile.

The methods disclosed herein include and encompass, in addition to methods of making and using the disclosed devices and systems, methods of instructing others to make and use the disclosed devices and systems. For example, a method in accordance with a particular embodiment includes positioning a surface dryer proximate to a surface, driving a flow of air into the surface dryer by an impeller via an inlet aperture, accelerating the flow of air by a convergent portion, decelerating the flow of air by a divergent portion, and discharging the flow of air to the surface. A method in accordance with another embodiment includes instructing such a method. Such instructions can be contained on any suitable computer readable medium. Accordingly, any and all methods of use or manufacture disclosed herein also fully disclose and enable corresponding methods of instructing such methods of use or manufacture.

Aspects of the foregoing embodiments can provide the foregoing advantages without suffering from disadvantages associated with other techniques for improving exit flow velocity distributions. For example, alternative approaches to achieving a uniform or partially uniform exit velocity distribution include installing turning vanes or an exit grille in the exit nozzle. These techniques may provide an exit velocity distribution improvement, but may also produce large back pressures, which reduce the overall efficiency of the air dryer and/or require a larger motor to achieve the same volumetric or mass rate of air flow. In addition, installing such features in the exit nozzle increases the complexity of the nozzle and requires additional manufacturing and installation steps, which can increase the cost of the dryer.

From the foregoing, it will be appreciated that specific embodiments of the disclosed technology have been described herein for purposes of illustration, but that various modifications may be made without deviating from the technology. For example, the nozzle can have exit shapes different than those expressly described above, while still benefiting from the convergent-divergent features described above. Embodiments of the air dryer can be placed on inclined surfaces that are not horizontal, and/or can dry surfaces that are neither horizontal nor vertical. Certain aspects of the technology described in the context of particular embodiments may be combined or eliminated in other embodiments. Further, while advantages associated with certain embodiments of the disclosed technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

We claim:

1. An air dryer mover for producing uniform air velocity profiles, comprising:

a dryer housing at least partially enclosing an interior chamber;

an impeller positioned within the interior chamber to drive a flow of air along an airflow path;

an inlet having an inlet aperture; and a nozzle having an outlet aperture having an asymmetric pinched the nozzle further having:

a convergent portion positioned to accelerate the flow of air; and a divergent portion positioned to decelerate the flow of air;

wherein the airflow path includes a first segment located at the inlet aperture, a second segment located at the convergent portion, a third segment located at the divergent portion, and a fourth segment located at the outlet aperture.

2. The air mover of claim 1 wherein the first segment is generally perpendicular to the fourth segment, and wherein the second segment is generally parallel to the third segment.

3. The air mover of claim 1, further comprising a support device having an engaging surface positioned to contact a target surface.

4. The air mover of claim 1, further comprising a support device positioned to locate the inlet at a predetermined height relative to a target surface.

5. The air mover of claim 1 wherein the inlet aperture has a concave contoured shape and wherein the housing has a corresponding convex contoured lower surface that at least partially matches the concave contoured shape.

6. The air mover of claim 1 wherein the convergent portion and the divergent portion are smoothly contoured.

7. The air mover of claim 1 wherein the outlet aperture has an asymmetric shape positioned to locally adjust an air velocity of a portion of the flow of air at the outlet aperture.

8. A surface dryer for removing moisture from a target surface, comprising:

a dryer housing;

a gas driver positioned in the housing to drive a flow of air along an airflow path;

an inlet aperture formed in the housing and positioned to receive the flow of air;

and a nozzle carried by the housing, the nozzle having:

an indentation forming a convergent portion positioned to accelerate the flow of air and a divergent portion positioned to decelerate the flow of air; and an outlet aperture positioned downstream of the indentation and having an asymmetric pinched region.

9. The surface dryer of claim 8 wherein the outlet aperture has an asymmetric shape positioned to locally adjust an air velocity of a portion of the flow of air.

10. The surface dryer of claim 8 wherein the housing has a first side facing a first direction and a second side facing a second direction opposite the first direction, and wherein the indentation is on the first side, and the surface dryer further comprises a support device positioned at the second side and having an engaging surface.

11. The surface dryer of claim 8, further comprising a support device positioned to locate the inlet at a predetermined height relative to a target surface.

12. The surface dryer of claim 8 wherein the indentation is a first indentation, and wherein the nozzle includes a second indentation positioned opposite to the first indentation.

13. The surface dryer of claim 8 wherein the inlet aperture has a concave contoured shape and wherein the housing has a corresponding convex contoured lower surface that at least partially matches the concave contoured shape.

14. The surface dryer of claim 8 wherein the convergent portion and the divergent portion together form a venturi device.

15. A method of drying surfaces, comprising:

positioning a surface dryer proximate to a surface, wherein the surface dryer has a housing and a support device coupled to the housing, and wherein the support device contacts the surface;

directing a flow of air through an inlet aperture and into the housing via an impeller carried by the housing;

accelerating the flow of air at a convergent portion of the housing;

decelerating the flow of air at a divergent portion of the housing;

discharging the flow of air through an outlet aperture of the housing; and locally adjusting a portion of the flow of air at an asymmetric pinched region of the outlet aperture.

16. The method of claim 15 wherein the surface is a first surface, and wherein the method further comprises discharging the flow of air via the outlet aperture to a second surface generally perpendicular to the first surface.

17. The method of claim 15 wherein the surface dryer is a first surface dryer, and wherein the method further comprises stacking a second surface dryer on the first surface dryer, and wherein the inlet aperture of the first surface dryer has a concave contoured shape at least partially matching a convex contoured surface of the second surface dryer.

18. The method of claim 15, further comprising locally accelerating the portion of the flow of air at the outlet aperture via the asymmetric pinched region, wherein the asymmetric pinched region is positioned at only one end of the outlet aperture.

19. The method of claim 15, further comprising forming a V-shaped velocity profile across the outlet aperture.

20. The method of claim 15, further comprising forming a uniform velocity profile at the outlet aperture with an exit velocity variance at least less than 40%.

* * * * *